US006732537B1

(12) United States Patent
Anell et al.

(10) Patent No.: US 6,732,537 B1
(45) Date of Patent: May 11, 2004

(54) ICE MAKER AIR DELIVERY ASSEMBLY

(75) Inventors: Thomas Carl Anell, Knoxville, IL (US); Larry Edward Dietz, Galesburg, IL (US); William James Vestal, Monmouth, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/385,638

(22) Filed: Mar. 12, 2003

(51) Int. Cl.[7] ..... F25C 1/12
(52) U.S. Cl. ..... 62/71; 62/353; 62/420
(58) Field of Search ..... 62/71, 73, 351, 62/353, 420

(56) References Cited

U.S. PATENT DOCUMENTS

| | | | | |
|---|---|---|---|---|
| 3,055,186 A | * | 9/1962 | Linstromberg et al. | 62/186 |
| 3,146,606 A | * | 9/1964 | Grimes et al. | 62/233 |
| 3,270,519 A | * | 9/1966 | Pohl, Jr. | 62/353 |
| 3,866,434 A | | 2/1975 | Pugh et al. | 62/340 |
| 4,635,444 A | | 1/1987 | Mawby et al. | 62/125 |
| 4,680,943 A | | 7/1987 | Mawby et al. | 62/300 |
| 6,176,099 B1 | | 1/2001 | Hynes | 62/344 |
| 6,351,955 B1 | | 3/2002 | Oltman et al. | 62/71 |

FOREIGN PATENT DOCUMENTS

| | | |
|---|---|---|
| JP | 11-173736 | 7/1999 |

* cited by examiner

*Primary Examiner*—William E. Tapolcai
(74) *Attorney, Agent, or Firm*—Diederiks & Whitelaw, PLC

(57) ABSTRACT

An air delivery unit for an ice maker is located in a freezer compartment having an outer wall spaced apart from an inner wall. The air delivery unit includes an air tunnel, an air deflector, and a restrictor plate. The air tunnel has a first end and a second end, wherein the first end is positioned adjacent to an ice mold of the ice maker and the second end is positioned adjacent to the inner wall of the freezer. The air deflector extends from the second end of the air tunnel between the inner and outer walls of the freezer to redirect air through the air tunnel and onto the ice mold. Further, the restrictor plate is attached to the air tunnel for restricting air flow above the air tunnel. The air delivery system is designed to readily snap-lock to the inner wall.

19 Claims, 4 Drawing Sheets

ICE MAKER AIR DELIVERY ASSEMBLY

BACKGROUND OF THE INVENTION

1. Field of the Invention

The present invention pertains to the art of ice makers and, more particularly, to an air delivery assembly for an ice maker.

2. Discussion of the Prior Art

It is now common practice in the art of refrigerators to provide an automatic ice maker within a freezer compartment of a refrigerator and further to provide a system for dispensing the ice into a recessed receiving area formed in a front panel of the refrigerator. In essence, these systems provide for the automatic filling of ice cube trays which are emptied into a bin following a freezing period. From the bin, the ice can be delivered to the receiving area by the selective activation of a drive unit, such as a rotatable auger located within the bin. Most often, such ice dispensing systems incorporate a mechanism whereby the ice can be selectively crushed prior to reaching the receiving area.

If a large quantity of ice is needed in a short period of time, it is possible for the ice stored within the bin to be depleted. Therefore, a user is required to wait for the ice maker to form more ice. The rate at which the ice is formed is dependent upon the temperature of the liquid supplied to the ice trays and the temperature of the air surrounding the ice trays.

Some attempts have been made to increase the rate of ice production. For example, U.S. Pat. No. 6,351,955 discloses a method for improving the rate of ice production by providing a fan selectively operable to direct cooled air across the ice making surfaces of the ice maker during the ice formation process. A potential drawback with the use of a fan to aid in ice formation is the increased costs associated with including and operating an additional component in the freezer.

Another example of a prior attempt to increase the rate of ice production is disclosed in U.S. Pat. No. 6,176,099. In the '099 patent, an air flow deflection baffle is positioned within an ice making assembly to direct air, which would normally pass out of the ice forming chamber, over the water in the ice forming chamber. However, this arrangement only applies to ice makers having an ice forming chamber, rather than ice makers having a fill tube and an ice tray that are exposed within the freezer compartment.

Based on the above, there is a need in the art for an ice maker assembly that leads to an increase in the rate of ice formation in an ice tray, without adding substantial costs to the production of the overall assembly and without adding additional motorized parts.

SUMMARY OF THE INVENTION

The present invention is directed to an air delivery assembly for an ice maker located in a freezer having an outer wall spaced apart from an inner wall. The air delivery assembly includes an air tunnel, an air deflector, and a restrictor plate. The air tunnel has a first end and a second end, wherein the first end is positioned adjacent to an ice mold cavity and the second end is positioned adjacent to the inner wall of the freezer. The air deflector is located adjacent to the second end of the air tunnel, substantially perpendicular to the inner wall of the freezer. By positioning the air deflector between the inner and outer walls of the freezer, the air deflector redirects air between the walls, through the air tunnel, and onto the ice mold. Further, the restrictor plate is attached to the air tunnel for restricting air flow above the air tunnel at a rate equal to the increase of air flow through the air tunnel based on the presence of the air deflector. Preferably, the air delivery system readily snap-locks to the inner wall of the freezer, which is preferably an evaporator coil cover.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
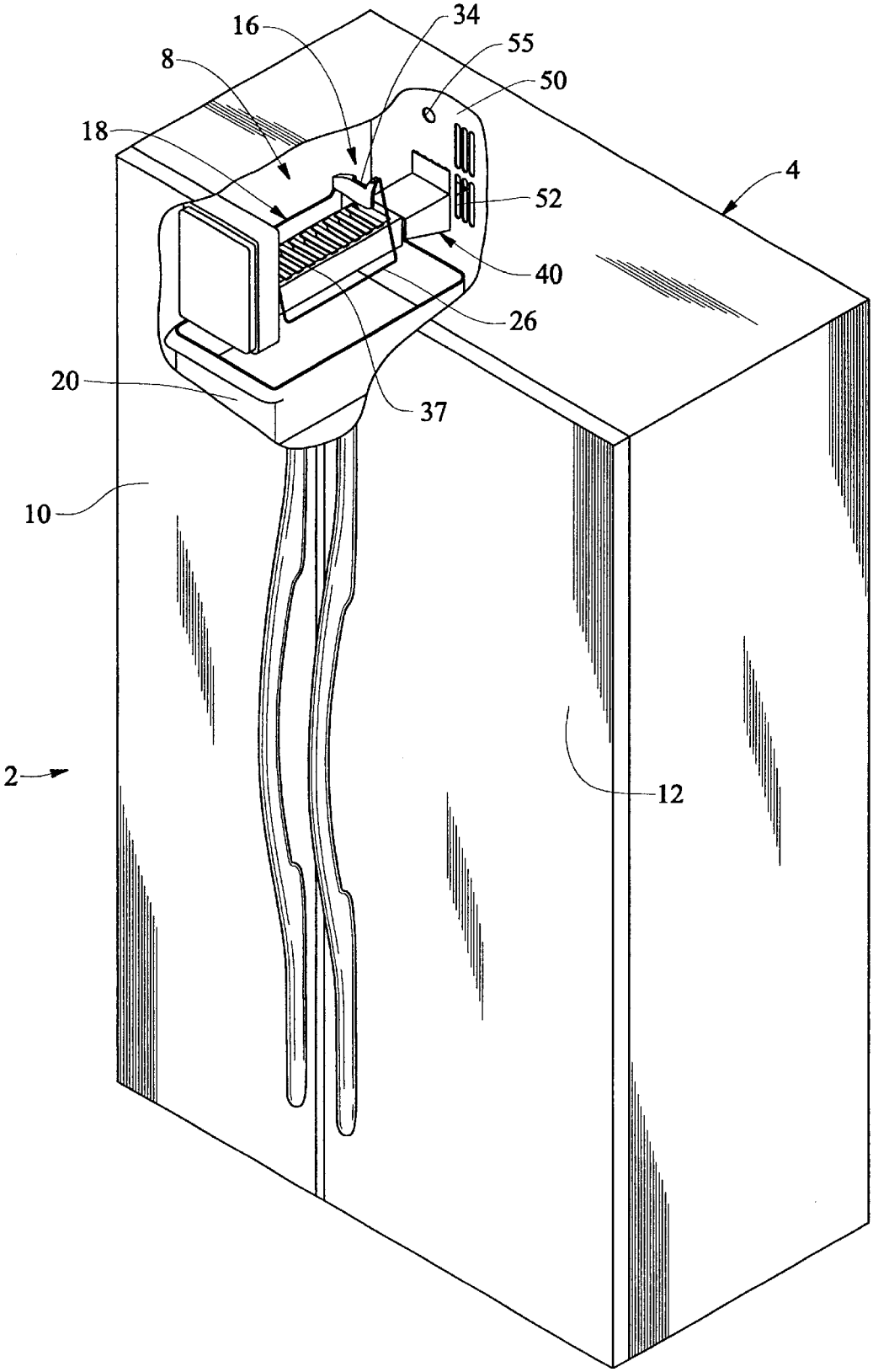
FIG. 1 is an upper perspective view of a refrigerator with a portion cut-away to expose a freezer compartment housing an ice maker assembly including an air delivery unit constructed in accordance with the present invention.

With initial reference to FIG. 1, a refrigerator, generally indicated at 2, includes a cabinet 4 within which is defined a freezer compartment 8. Freezer compartment 8 can be selectively accessed through the pivoting of freezer door 10. Also provided is a fresh food door 12 which enables access to a fresh food compartment (not shown). As shown, refrigerator 2 constitutes a side-by-side style unit.

Arranged within freezer compartment 8 is an ice maker assembly 16. In a manner known in the art, ice maker assembly 16 includes an ice maker unit 18 and an ice storage bin 20. Ice maker unit 18 is shown to include a bale arm 26 which is pivotable upward and downward based on the amount of ice retained in storage bin 20. Bale arm 26 is actually pivotally connected to a switch arm 34.

Ice maker unit 18 also includes an ice mold 37. In general, this construction, as well as the operation of ice maker unit 18, is known in the art. Basically, the flow of water is directed to ice mold 37 by a fill tube (not shown) to fill up various cavities (not separately labeled) of ice mold 37 in order to produce ice cubes which are deposited into storage bin 20. When storage bin 20 has collected a sufficient number of ice cubes, the stored ice cubes will act on bale arm 26 to cause bale arm 26 to be lifted which, in turn, operates on switch arm 34 to de-activate ice maker unit 18. Bale arm 26 is biased downward to an ice making position such that, when a sufficient number of ice cubes are removed from storage bin 20, ice maker unit 18 will be automatically reactivated. Since such automatic ice makers are widely known in the art, further details thereof will not be discussed here.

Figure 2:
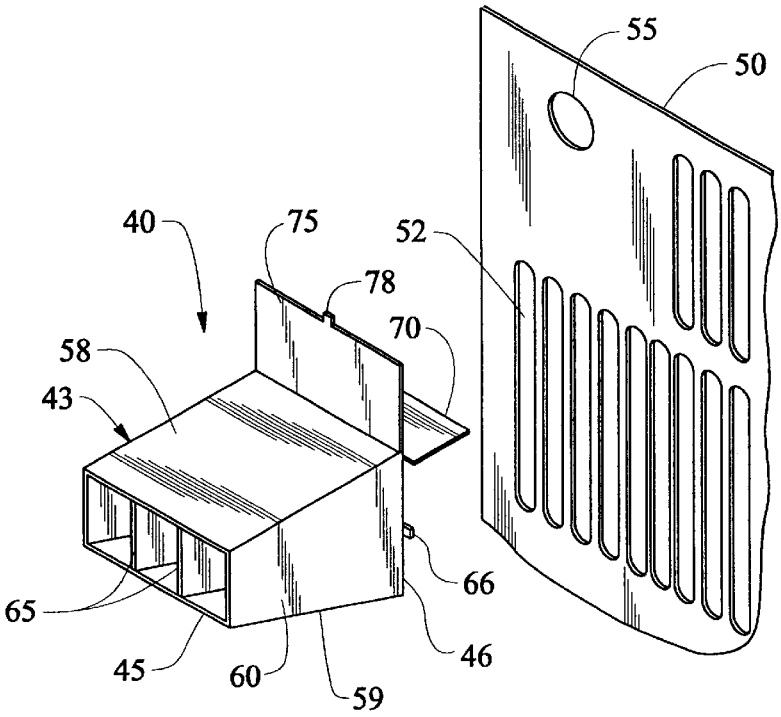
FIG. 2 is an exploded, perspective view of the air delivery unit of the ice maker assembly of FIG. 1 and an associated evaporator coil cover.

The present invention is particularly directed to an air delivery unit 40 of ice maker assembly 16. With specific reference to FIGS. 2 and 3, air delivery unit 40 includes air tunnel 43 having a first open end 45 and a second open end 46. First end 45 is positioned adjacent to ice mold 37 so that air blowing out of air tunnel 43, as will be discussed more fully below, is directed onto mold cavity 37. Second end 46 of tunnel 43 is positioned adjacent to an inner wall 50 of the freezer compartment 8. In the most preferred embodiment shown, inner wall 50 actually constitutes an extension of an evaporator coil cover. As shown, inner wall 50 includes a plurality of openings in the form of vertical slots 52 and a hole 55 through with the water fill tube, as discussed above, extends.

Air tunnel 43 also includes a top surface 58, a bottom surface 59, and two side surfaces, one of which is indicated at 60. Each side surface 60 is tapered such that each side surface 60 is narrower at first end 45 than at second end 46 of air tunnel 43. In addition, a plurality of vertical partitions 65, two in the preferred embodiment depicted, extend between top and bottom surfaces 58 and 59, from first end 45 to second end 46, of air tunnel 43. The tapering of air tunnel 43 and vertical partitions 65 direct and concentrate the air flow through air tunnel 43 so that the air impinges upon ice mold 37. At this point, it should be noted that air tunnel 43 is also provided with a plurality of outwardly projecting tabs 66–68 to aid in securing air delivery unit 40 to inner wall 50 as detailed below.

Figure 3:
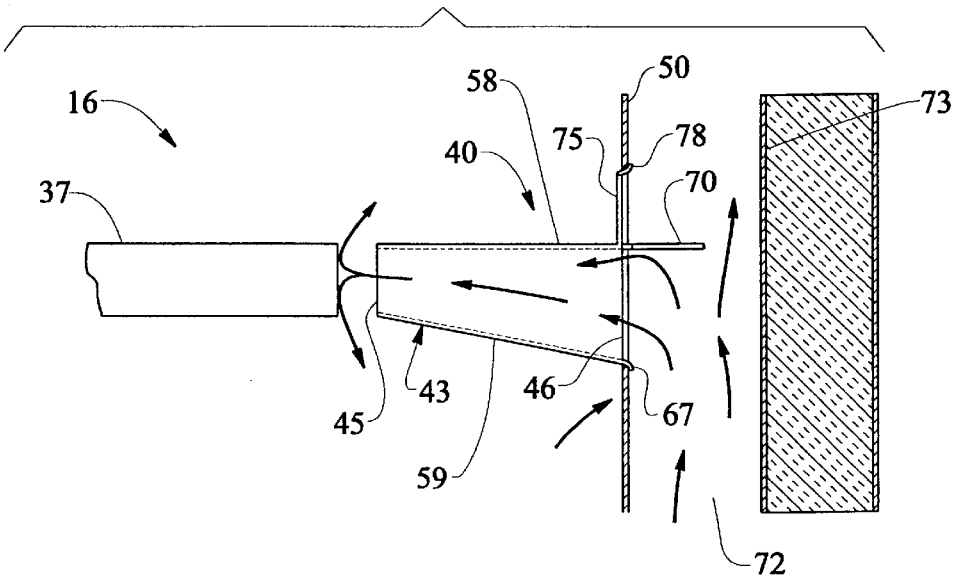
FIG. 3 is a cross-sectional side view taken within the freezer compartment of FIG. 1.
Figure 4:
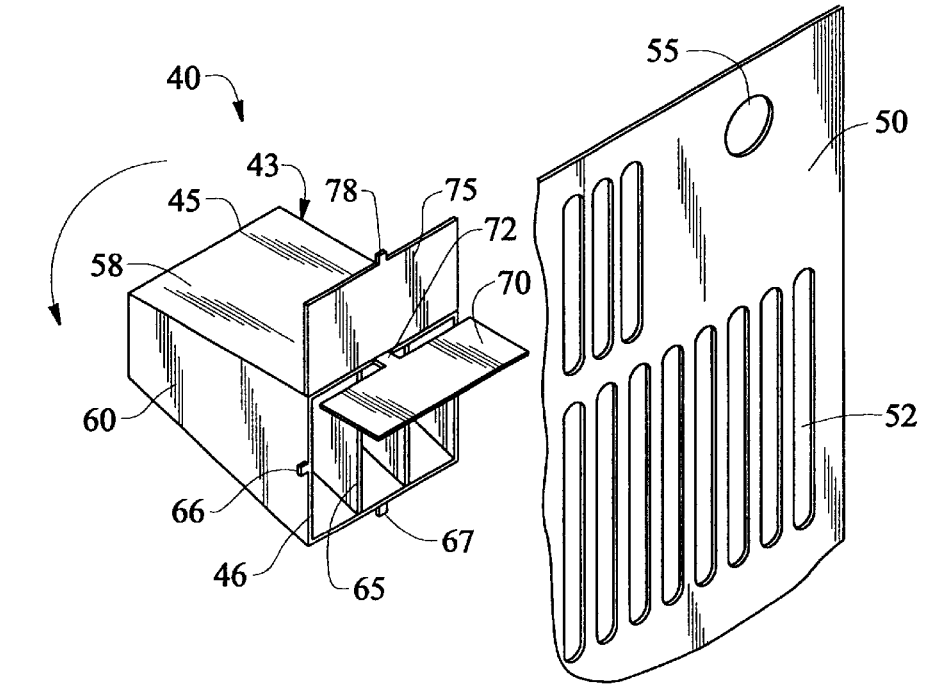
FIG. 4 is an exploded, rear perspective view of the air delivery unit of FIG. 2.
Figure 5:
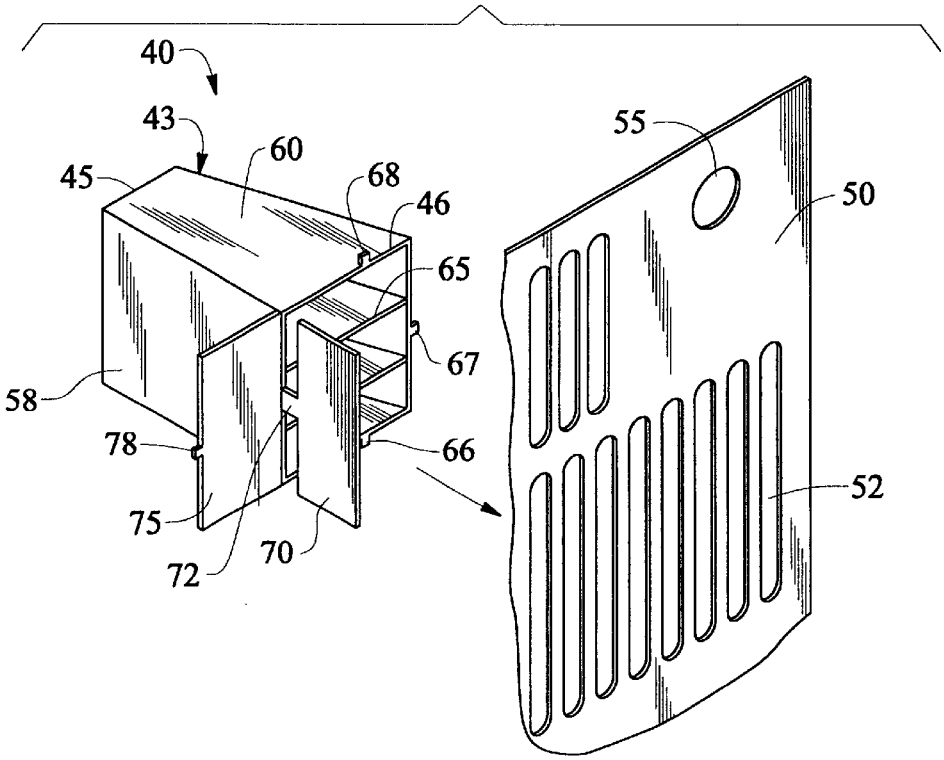
FIG. 5 is an exploded perspective view, similar to that of FIG. 4, illustrating an initial mounting stage for the air delivery unit.

In the most preferred form of the invention, air delivery unit 40 further includes an air deflector 70 which is located adjacent to second end 46 of air tunnel 43. Air deflector 70 constitutes a rectangular plate that is generally in the same plane as top surface 58 of air tunnel 43 and extends substantially perpendicular to inner wall 50 of freezer compartment 8. Air deflector 70 is interconnected to air tunnel 43 by a space bar 71. This arrangement is considered to provide a convenient arrangement for attaching of air delivery unit 40 to inner wall 50 as will be discussed further below. When air delivery unit 40 is attached to inner wall 50 as shown in FIG. 3, air deflector 70 is located in a plenum 72 defined between inner wall 50 and outer insulated freezer liner wall 73. In a manner known in the art, a flow of cooling air is developed in plenum 72, which typically houses an evaporator coil (not shown), and this cooling air is lead into freezer compartment 8 through slots 52 in inner wall 50. In any case, in accordance with the present invention, air deflector 70 serves to redirect a portion of the air traveling within plenum 72 into air tunnel 43 and onto ice mold 37, as indicated by the arrows in FIG. 3.

Air delivery unit 40 also preferably includes a restrictor plate 75 extending from air tunnel 43 for restricting air flow through a select number of slots 52 directly above air tunnel 43 by an amount preferably equal to the increase of air flow through air tunnel 43 due to the presence of air deflector 70. Most preferably, restrictor plate 75 extends upward from top surface 58 of air tunnel 43 at second end 46. When air delivery unit 40 is attached to inner wall 50, restrictor plate 75 is flush against inner wall 50. Restrictor plate 75 includes a tab 78 to aid in securing air delivery unit 40 to inner wall 50 as will also be detailed below.

Figure 6:
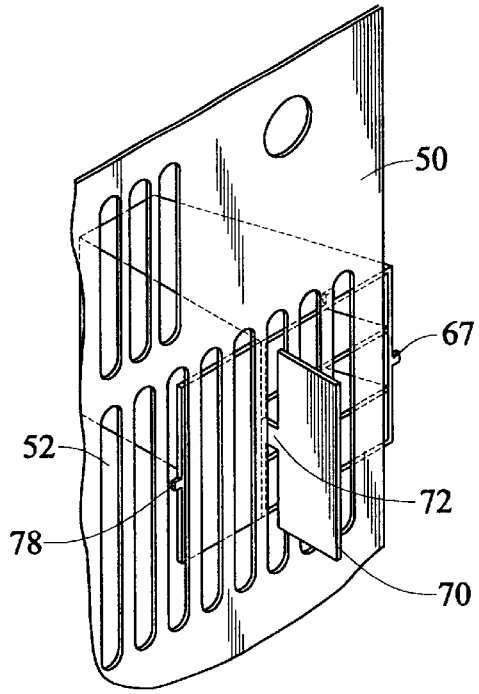
FIG. 6 is a perspective view illustrating an intermediate mounting stage for the air delivery unit of the ice maker assembly.
Figure 7:
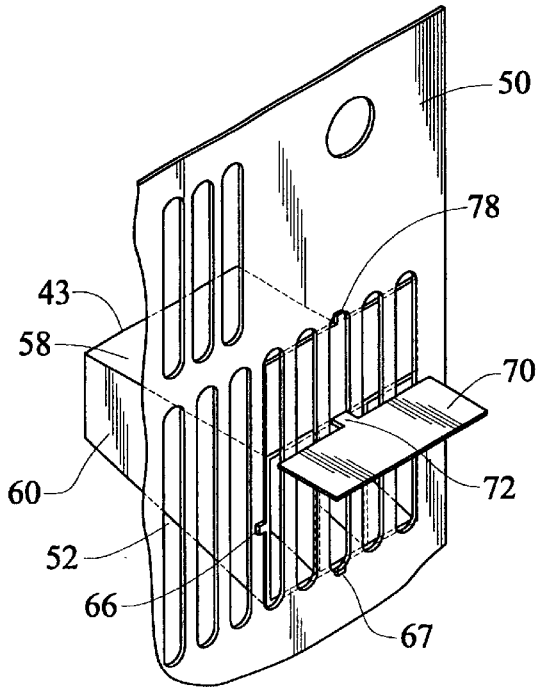
FIG. 7 is a perspective view illustrating a final mounting configuration for the air delivery unit of the invention.

The manner in which air delivery unit 40 is attached to inner wall 50 in accordance with the most preferred embodiment of the invention, which employs a twist mounting arrangement, will now be detailed with particular reference to in FIGS. 4–7. In order to attach air delivery unit 40 to inner wall 50, air delivery unit 40 is rotated from the position shown in FIG. 4 to the position shown in FIG. 5 such that air deflector 70 is aligned with a selected one of slots 52 of inner wall 50. Next, air delivery unit 40 is moved toward inner wall 50 until air deflector 70 can pass through the selected slot 52. When air deflector 70 is inserted in this manner, space bar 72 extends through the slot 52 as shown in FIG. 6. Since space bar 72 is as narrow as the slot 52, air delivery unit 40 may then be rotated to an upright, operational position as shown in FIG. 7.

At this point, air deflector 70 is located in plenum 80 between inner and outer walls 50 and 73 of freezer compartment 8 as shown in FIG. 3. Tabs 66–68 and 78 located on air tunnel 43 and restrictor plate 75 are then positioned in respective slots 52 to hold air delivery unit 40 in position. More specifically, air delivery unit 40 is preferably molded of plastic and portions thereof are maneuvered and/or deflected to cause tabs 66–68 and 78 to engage inner wall 50 through respective slots 52 as best illustrated in FIGS. 3 and 7. Due to this mounting arrangement, air delivery unit 40 may be easily removed for cleaning or maintenance by disengaging tabs 66–68 and 78, followed by twisting of air delivery unit 40, such that air deflector 70 is aligned to travel out through the respective slot 52. Of course, the actual construction of air delivery unit 40 would depend on the particular ice maker arrangement, the overall refrigerator freezer compartment configuration, and the design for inner wall 50.

With this arrangement, air delivery unit 40 serves to enhance the performance of ice maker unit 18, especially under low fill level conditions. More specifically, high velocity air from freezer air plenum 72 is diverted directly onto ice mold 37 by use of air delivery unit 40. Therefore, air delivery unit 40 uses forced convection heat transfer to accelerate the freezing of ice in ice mold 37. Further, with the inclusion of restrictor plate 75 to additionally control the air flow, air delivery unit 40 can be advantageously installed in freezer compartment 8 without impacting overall cabinet thermal performance.

Although described with reference to a preferred embodiment of the invention, it should be readily understood that various changes and/or modifications can be made to the invention without departing from the spirit thereof. In general, the invention is only intended to be limited by the scope of the following claims.

We claim:

1. In a refrigerator including a freezer compartment having an outer wall spaced apart from an inner wall so as to define an air flow plenum therebetween, with openings formed in the inner wall to allow air to flow from the plenum to the freezer compartment, an ice maker assembly comprising:

an ice mold for containing water to be frozen into ice cubes; and an air delivery unit including an air tunnel having a first end and a second end, as well as a plurality of partitions formed in the air tunnel, said first end being positioned adjacent to the ice mold and said second end being positioned adjacent to the inner wall of the freezer compartment, wherein air is directed from between the inner wall and the outer wall, into the openings in the inner wall, through the air tunnel and against the ice mold.

2. The ice maker assembly according to claim 1, wherein the inner wall constitutes an extension of an evaporator cover.

3. The ice maker assembly according to claim 1, wherein the air delivery unit is integrally molded of plastic.

4. In a refrigerator including a freezer compartment having an outer wall spaced apart from an inner wall so as to define an air flow plenum therebetween, with openings formed in the inner wall to allow air to flow from the plenum to the freezer compartment, an ice maker assembly comprising:

an ice mold for containing water to be frozen into ice cubes;

an air delivery unit including an air tunnel having a first end and a second end, said first end being positioned adjacent to the ice mold and said second end being positioned adjacent to the inner wall of the freezer compartment, wherein air is directed from between the inner wall and the outer wall, into the openings in the inner wall, through the air tunnel and against the ice mold; and an air deflector, located adjacent the second end of the air tunnel and arranged between the inner and outer walls of the freezer compartment, for directing the air into the air tunnel.

5. The ice maker assembly according to claim 4, wherein the air deflector extends substantially perpendicular to the inner wall.

6. The ice maker assembly according to claim 4, wherein the air tunnel and the air deflector are integrally formed.

7. The ice maker assembly according to claim 6, wherein the air deflector is connected to the air tunnel through a spacer bar which extends through one of the openings in the inner wall.

8. The ice maker assembly according to claim 4, further comprising: a restrictor plate extending from the air tunnel and over at least portions of a plurality of the openings in the inner wall for restricting air flow around the air tunnel.

9. The ice maker assembly according to claim 8, wherein the restrictor plate restricts air flow by an amount substantially equal to the increase of air flow through the air tunnel due to the air deflector.

10. In a refrigerator including a freezer compartment having an outer wall spaced apart from an inner wall so as to define an air flow plenum therebetween, with openings formed in the inner wall to allow air to flow from the plenum to the freezer compartment, an ice maker assembly comprising:

an ice mold for containing water to be frozen into ice cubes;

an air delivery unit including an air tunnel having a first end and a second end, said first end being positioned adjacent to the ice mold and said second end being positioned adjacent to the inner wall of the freezer compartment, wherein air is directed from between the inner wall and the outer wall, into the openings in the inner wall, through the air tunnel and against the ice mold; and a plurality of tabs provided on the air delivery unit, said air tunnel being attached to the inner wall through the plurality of tabs.

11. The ice maker assembly according to claim 10, further comprising: a restrictor plate extending from the air tunnel and over at least portions of a plurality of the openings in the inner wall for restricting air flow around the air tunnel, wherein at least one of the tabs extends from the restrictor plate.

12. In a refrigerator including a freezer compartment having an outer wall spaced apart from an inner wall so as to define an air flow plenum therebetween, with openings formed in the inner wall to allow air to flow from the plenum to the freezer compartment, an ice maker assembly comprising:

an ice mold for containing water to be frozen into ice cubes; and an air delivery unit including an air tunnel having a first end and a second end, wherein the air tunnel narrows from the second end to the first end, said first end being positioned adjacent to the ice mold and said second end being positioned adjacent to the inner wall of the freezer compartment, wherein air is directed from between the inner wall and the outer wall, into the openings in the inner wall, through the air tunnel and against the ice mold.

13. The ice maker assembly according to claim 12, further comprising: a plurality of partitions formed in the air tunnel.

14. A method of making ice in a freezer compartment having an inner wall spaced apart from an outer wall, comprising the steps of:

adding water to an ice mold;

directing cool air from between the inner wall and outer wall through openings formed in the inner wall, into an air tunnel having a first end adjacent to the inner wall of the freezer compartment and the second end adjacent to the ice mold, and onto the ice mold; and concentrating the cool air on the ice mold due to narrowing of the air tunnel from the first end to the second end.

15. The method of claim 14, further comprising: mounting the air tunnel in the freezer compartment by interconnecting a plurality of tabs carried by the air tunnel to the inner wall.

16. The method of claim 14, further comprising: partitioning the flow of cool air within the air tunnel.

17. A method of making ice in a freezer compartment having an inner wall spaced apart from an outer wall, comprising the steps of:

adding water to an ice mold;

directing cool air from between the inner wall and outer wall through openings formed in the inner wall, into an air tunnel having a first end adjacent to the inner wall of the freezer compartment and the second end adjacent to the ice mold, and onto the ice mold; and increasing air flow through the air tunnel by positioning an air deflector between the inner and outer walls to direct air into the air tunnel.

18. The method of claim 17, further comprising: restricting air flow around the air tunnel by arranging a restrictor plate over a plurality of the openings formed in the inner wall at a rate substantially equal to the increase of air flow through the air tunnel due to the air deflector.

19. The method of claim 17, further comprising: concentrating the cool air on the ice mold due to narrowing of the air tunnel from the first end to the second end.

* * * * *